US008907785B2

(12) United States Patent
Huseth et al.

(10) Patent No.: US 8,907,785 B2
(45) Date of Patent: Dec. 9, 2014

(54) LOCATOR SYSTEM USING DISPARATE LOCATOR SIGNALS

(75) Inventors: Steve Huseth, Plymouth, MN (US); Cleopatra Cabuz, Eden Prairie, MN (US)

(73) Assignee: Honeywell International Inc., Morristown, NJ (US)

( * ) Notice: Subject to any disclaimer, the term of this patent is extended or adjusted under 35 U.S.C. 154(b) by 546 days.

(21) Appl. No.: 13/207,247

(22) Filed: Aug. 10, 2011

(65) Prior Publication Data

US 2013/0038446 A1 Feb. 14, 2013

(51) Int. Cl.

| | |
|---|---|
| ***G08B 1/08*** | (2006.01) |
| ***G08B 29/18*** | (2006.01) |
| ***G08B 21/02*** | (2006.01) |

(52) U.S. Cl.

CPC ..... *G08B 21/0202* (2013.01); *G08B 29/183* (2013.01)

USPC ..... 340/539.13; 340/932.2; 340/539.11; 340/539.23; 340/539.32; 340/933

(58) Field of Classification Search

USPC ..... 340/932.2, 539.11, 539.23, 539.32, 340/933; 701/2

See application file for complete search history.

(56) References Cited

U.S. PATENT DOCUMENTS

| | | | | |
|---|---|---|---|---|
| 6,720,921 | B2 | 4/2004 | Ripingill, Jr. et al. | |
| 7,102,510 | B2 | 9/2006 | Boling et al. | |
| 7,111,783 | B2 | 9/2006 | Xi et al. | |
| 7,246,008 | B2 | 7/2007 | Daubert et al. | |
| 7,369,061 | B1 * | 5/2008 | Sellers et al. | 340/932.2 |
| 7,420,510 | B2 | 9/2008 | Kolavennu et al. | |
| 7,583,275 | B2 | 9/2009 | Neumann et al. | |
| 7,606,579 | B2 | 10/2009 | Thacher | |
| 7,715,980 | B2 | 5/2010 | Bargeron et al. | |
| 7,733,836 | B2 | 6/2010 | Huseth | |

(Continued)

FOREIGN PATENT DOCUMENTS

| | | |
|---|---|---|
| JP | 2007183432 | 7/2007 |
| JP | 2007333998 | 12/2007 |
| WO | 2010107379 | 9/2010 |

OTHER PUBLICATIONS

Davies et al., "Scalable, Distributed, Real-Time Map Generation," IEEE, Intelligent Transport Systems, pp. 47-54, 2006.

(Continued)

*Primary Examiner* — Daryl Pope

(74) *Attorney, Agent, or Firm* — Seager Tufte & Wickhem LLC.

(57) ABSTRACT

The present disclosure relates generally to locating systems, and more particularly, to handheld locator systems for locating personnel or other objects in buildings or other environments. In one illustrative embodiment, a tag is attached to an object to be located (e.g. firefighter). The tag may be configured to emit a first signal and a second signal, where the first signal and the second signal having disparate propagation characteristics in the environment. In some cases, the first signal may be an acoustic signal and the second signal may be an RF signal, but this is not required in all embodiments. By using a first signal or set of signals, and then automatically switching to another signal or set of signal(s) when the first signal or set of signals are not received clearly, the tag/receiver system may help mitigate the failure modes/weaknesses of any single technology, and may provide advantages over use of any of the technologies used singly.

19 Claims, 4 Drawing Sheets

(56) References Cited

U.S. PATENT DOCUMENTS

| | | | | |
|---|---|---|---|---|
| 7,777,666 | B2 | 8/2010 | Gregory et al. | |
| 7,830,250 | B2 | 11/2010 | Huseth et al. | |
| 7,973,669 | B2 | 7/2011 | Pham et al. | |
| 7,982,614 | B2 | 7/2011 | Holm et al. | |
| 2003/0034887 | A1* | 2/2003 | Crabtree et al. | 340/539 |
| 2007/0205886 | A1 | 9/2007 | Huseth et al. | |
| 2007/0239350 | A1 | 10/2007 | Zumsteg et al. | |
| 2007/0239352 | A1 | 10/2007 | Thota et al. | |
| 2008/0033645 | A1 | 2/2008 | Levinson et al. | |
| 2008/0040669 | A1 | 2/2008 | Plocher et al. | |
| 2008/0068267 | A1 | 3/2008 | Huseth et al. | |
| 2008/0122696 | A1 | 5/2008 | Huseth et al. | |
| 2008/0158256 | A1 | 7/2008 | Rusell et al. | |
| 2008/0215524 | A1 | 9/2008 | Fuchs et al. | |
| 2008/0220780 | A1 | 9/2008 | Huseth et al. | |
| 2008/0228039 | A1 | 9/2008 | Huseth et al. | |
| 2009/0278912 | A1* | 11/2009 | Carter | 348/14.02 |
| 2011/0059698 | A1 | 3/2011 | Huseth et al. | |
| 2011/0082643 | A1 | 4/2011 | Huseth et al. | |
| 2011/0164768 | A1 | 7/2011 | Huseth et al. | |
| 2011/0248847 | A1 | 10/2011 | Huseth et al. | |

OTHER PUBLICATIONS htttp://www.sara.com/ISR/low__frequency__EM/magnetic__communication.html, "Magnetic Communications," 2 pages, Jun. 27, 2011.

Matsumoto, "Real-Time Multi-Sensor Localisation and Mapping Algorithms for Mobile Robots," 309 pages, 2009.

Yagi et al., "Real-Time Generation of Environmental Map and Obstacle Avoidance Using Omnidirectional Image Sensor with Conic Mirror," IEEE, pp. 160-165, 1991.

* cited by examiner

LOCATOR SYSTEM USING DISPARATE LOCATOR SIGNALS

FIELD

The present disclosure relates generally to locating systems, and more particularly, to handheld locator systems for locating personnel or other objects in buildings or other environments.

BACKGROUND

Locating system can be used to locate personnel or other objects in a building or other environment. Many locating systems face considerable challenges in accurately locating a person or object, particularly in a harsh environment, and also in presenting and communicating any detected location in a tangible and understandable form.

SUMMARY

The present disclosure relates generally to locating systems, and more particularly, to handheld locator systems for locating personnel or other objects in buildings or other environments. In one illustrative embodiment, a tag is attached to an object to be located. The tag may be configured to emit a first signal and a second signal, where the first signal and the second signal having disparate propagation characteristics in the environment. In some cases, the first signal may be an acoustic signal and the second signal may be an RF signal, but this is not required in all embodiments.

The first signal and the second signal may each be received by a hand-held receiver. A distance and/or direction of the tag relative to the hand-held receiver may then be determined based, at least in part, on the received first signal and the received second signal. In some cases, a confidence level for the first signal and a confidence level for the second signal may be determined. When so provided, it is contemplated that the distance and/or direction of the tag relative to the hand-held receiver may be based on the received first signal, the received second signal, the confidence level for the first signal, and the confidence level for the second signal. In some cases, a first weight may be applied to the first signal, and a second weight may be applied to the second signal wherein the first weight may be related to the confidence level for the first signal and the second weight may be related to the confidence level for the second signal.

The hand-held receiver may communicate the determined distance and/or bearing to an operator. Because the hand-held receiver may be expected to operate within a noisy, smoky and/or dangerous environment (e.g. a burning building), it is contemplated that the receiver may communicate the determined distance and/or bearing through several sensory channels, which may include a visual component, an audible component, and/or a tactile component, but this is not required.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION

The disclosure may be more completely understood in consideration of the following detailed description of various illustrative embodiments of the disclosure in connection with the accompanying drawings, in which.

Figure 3:
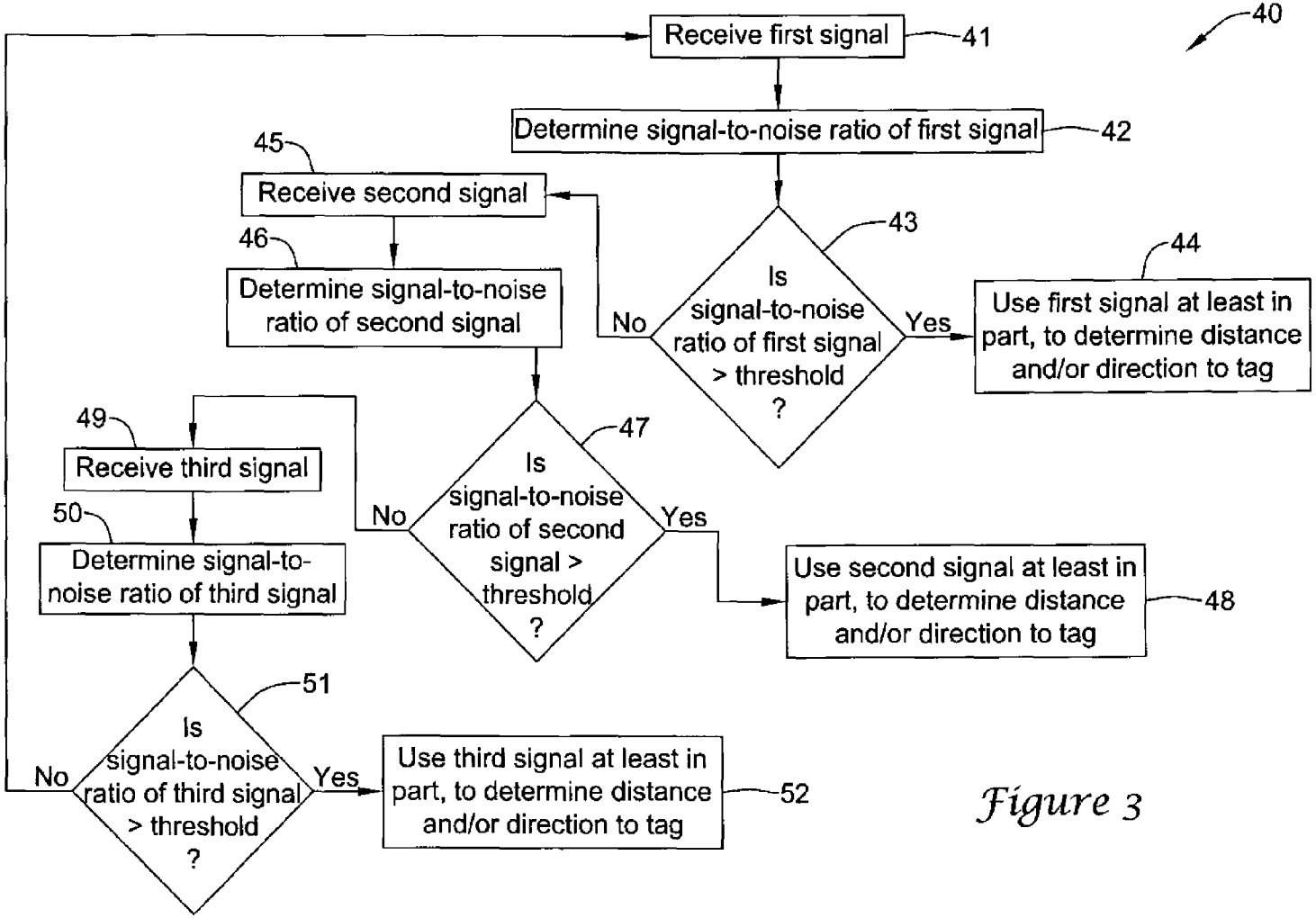
Figure 4:
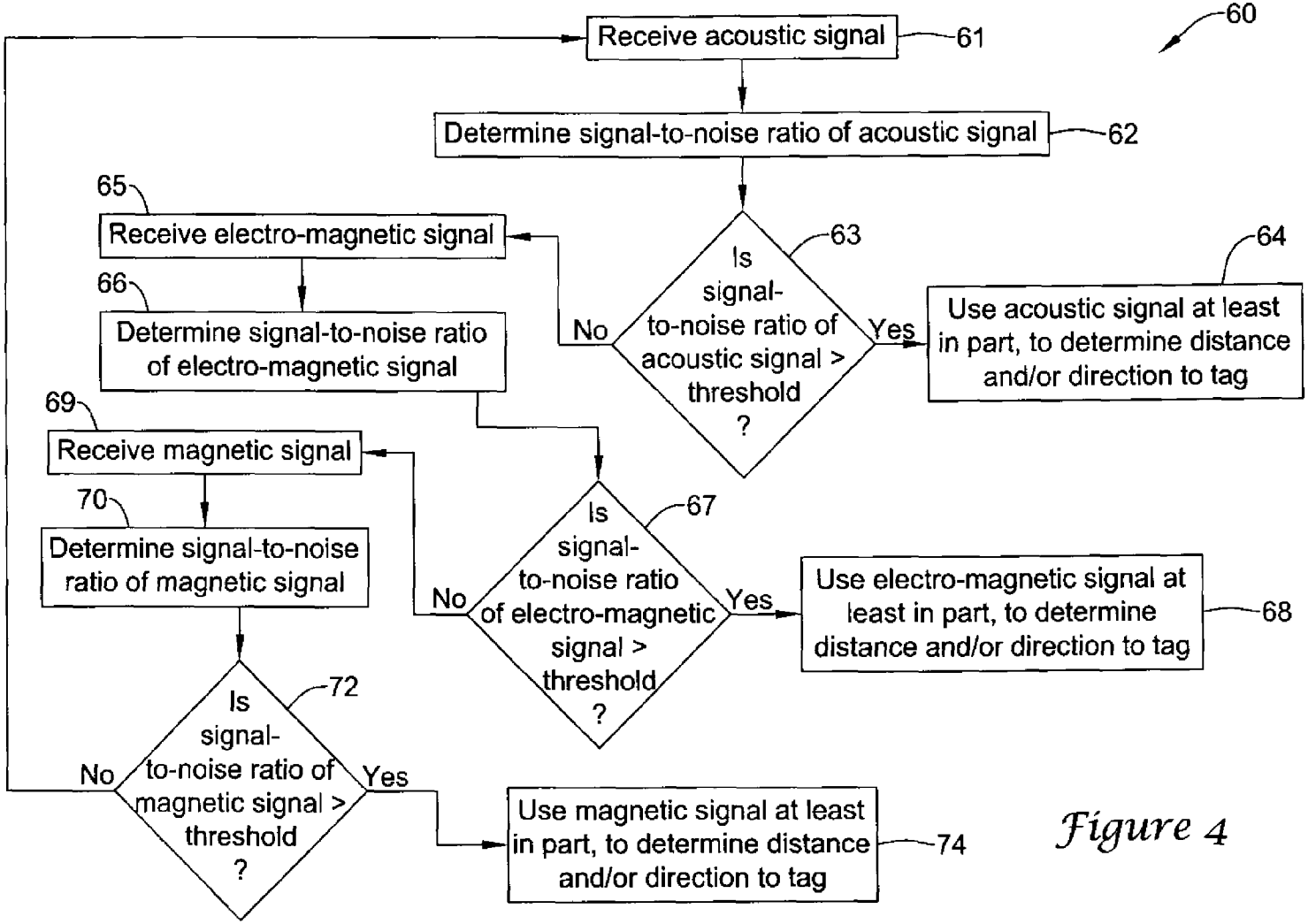

FIG. 3 is a flowchart of a selection algorithm for receiving first-, second- and third-signals from a tag, and for choosing which of the signals to use when determining a distance and/or a bearing to the tag; and FIG. 4 is a flowchart of a selection algorithm for receiving acoustic, electromagnetic and magnetic signals, and for choosing which of the signals to use when determining a distance and/or a bearing to the tag.

DESCRIPTION

The following description should be read with reference to the drawings wherein like reference numerals indicate like elements throughout the several views. The description and drawings show several examples that are meant to be illustrative of the disclosure.

While the examples below are described with reference to identifying a location of a firefighter, it should be recognized that the present disclosure may be applied to identifying the location of other personnel (e.g. miners) or even objects, as desired.

One of the most significant risks faced by a firefighter at the scene of a fire or incident is becoming lost or incapacitated within the burning structure. A typical self-contained breathing apparatus (SCBA) may provide less than 20 minutes of available air, so that localization, rescue and extraction of a fallen firefighter may have to be conducted in a period of less than eight minutes. A number of technologies and systems have been developed to help identify a position of a person and locate the person on a map. However, these systems often face considerable technical challenges in locating a person, and even greater challenges in presenting and communicating the location information in a tangible and understandable manner to an incident commander or other personnel.

In one example, firefighters may enter a building each wearing a tag that emits two or more signals. If one of the firefighters becomes hurt or lost and requires rescue, rescue personnel may enter the building with a hand-held receiver that can detect the signals emitted by the firefighter's tag. The hand-held receiver may be used to guide the rescue personnel to the hurt or lost firefighter. In some instances, the receiver may estimate a distance and a bearing to the tag based on the received signals, and may guide the rescue personnel to the tag through visual, auditory and/or tactile signals that are provided as feedback in real time as the rescue personnel move about the building.

In some cases, an illustrative tag/receiver system may use multiple technologies and have the tags simultaneously emit multiple signals that each rely on disparate physical principles for their propagation. In some cases, the signals may have disparate propagation characteristics, such as the distance range over which they may be effectively received, the ability to propagate through heavy building materials, sensitivity to metallic structures, the ability to avoid multipath effects in close proximity to the tag, and/or other disparate propagation characteristics. By using a first signal or set of signals, and then automatically switching to another signal or set of signal(s) when the first signal or set of signals are not received clearly, the tag/receiver system may help mitigate the failure modes/weaknesses of any single technology, and may provide advantages over use of any of the technologies used singly.

One example technology may include the use of ultrasonic or acoustic signals (e.g. sound waves) to propagate a signal outward from the tag. An acoustic signal may have a relatively short range, compared to other technologies or signal types. Since an acoustic or ultrasonic signal generally reflects off walls rather than passing through them, such a signal tends to reflect down hallways and through open doors, and may provide a path to effect a rescue. However, ultrasound signals may attenuate rapidly in cluttered buildings and may provide little or no signal if the doors are closed. In addition, use of an acoustic or ultrasonic tag in a large room may flood the room with multipath signals, which may make localization of the tag difficult.

Another example technology may include the use of an electromagnetic signal such as a Radio Frequency (RF) signal, an Infrared (IR) signal or any other suitable electromagnetic signal. In general, an RF signal may have a relatively long range compared to an acoustic signal. Also, inside of an open room, a low frequency RF signal may provide an accurate bearing to an RF tag, relatively free from multipath effects. RF signals, however, are often affected by metal structures and may not be able to provide a path down a hallway to the tag.

Another example technology may use a modulated magnetic signal. Magnetic signals may have the ability to communicate through conductive materials, such as earth, water, steel-reinforced concrete, and other materials where radio frequency (RF) transmissions would be blocked. Magnetic signals are typically free from multipath effects that are caused by multiple reflections within a confined space.

Because these and other signal types have different relative strengths and weaknesses in particular environments and under particular conditions, a system that uses a combination of different technologies may provide significant advantages over the use of just one of the technologies alone.

In general terms, the present approach may use two or more different types of signals to determine a distance and/or bearing of a tag. In some cases, acoustic, electromagnetic (e.g. RF) and/or magnetic signals may be used to identify a location of a tag or other object in a space such as a burning building. In some instances, a homing system may assess confidence levels for each of the signal types based on separate sensor measurements, and in some cases, may provide a composite result (e.g. composite distance and/or direction of the tag relative to the hand-held receiver) using the confidence levels. In some cases, the confidence levels may relate to signal-to-noise ratios of the one or more signals. The system may decide whether or not to use a particular signal based on a comparison of the signal-to-noise ratio to a predetermined threshold. Alternatively, or in addition, the system may use the confidence levels to calculate weights for each of the particular signals, and the weights may be used along with the corresponding signals to determine a distance and/or bearing to the tag. An example system that includes a tag and receiver is described below, followed by various example algorithms for determining the various signals to use in determine a distance and/or bearing to the tag.

Figure 1:
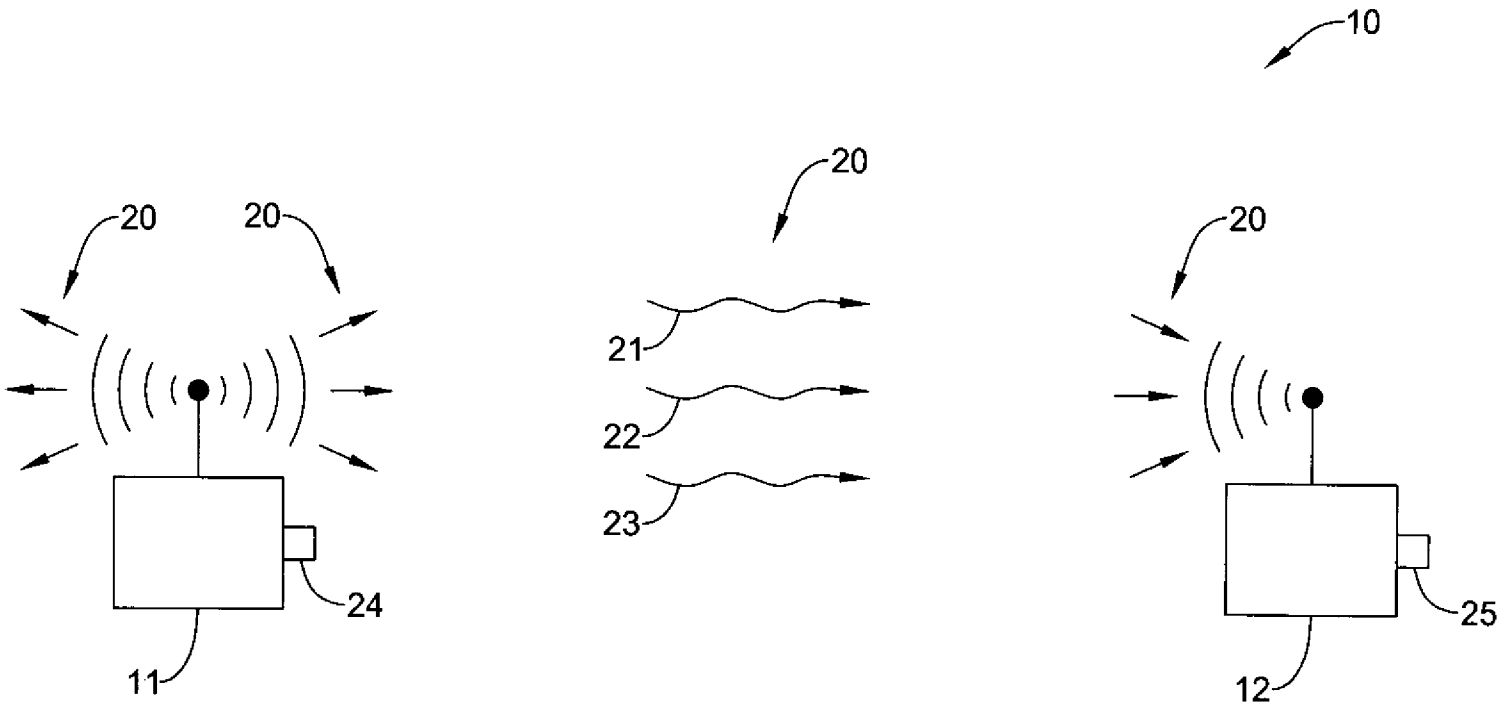
FIG. 1 is a schematic diagram of a tag emitting signals, and a hand-held receiver for receiving the signals and guiding a person to the tag.

FIG. 1 is a schematic diagram of a system 10 that includes a tag 11 and a receiver 12. It is understood that the system 10 may include multiple tags 11 and multiple receivers 12, and that the tags 11 may optionally include identifying features within their emitted signals so that any or all of the receivers 12 may hone in wirelessly on one particular tag if desired. For simplicity, only one tag 11 and one receiver 12 are shown in FIG. 1, with the understanding that other tags 11 and receivers 12 may operate in a similar manner. It is contemplated that both the tags 11 and receivers 12 of the system 10 may be relatively small, so that the tags 11 may be worn by respective firefighters or other personnel, and the receivers 12 may be carried by rescue personnel.

An illustrative tag 11 may simultaneously or sequentially emits several signal types 20, all or at least two of which use different physical principles for their propagation. The signals 20 may include some or all of an acoustic signal 21, an electromagnetic signal 22, a magnetic signal 23, and/or any other suitable signal, as desired. In some cases, some or all of the emitted signals 20 may be modulated and/or time synchronized coded signals, if desired.

In the example shown, an acoustic signal 21 may propagate at the speed of sound, while an electromagnetic signal 22 and a magnetic signal 23 may propagate at the speed of light. In some cases, the estimated distance from the receiver 12 to the tag 11 may be calculated based, at least on part, on the difference in arrival times at the receiver 12 between the acoustic signal 21 and the electromagnetic signal 22 or magnetic signal 23, multiplied by the speed of sound. In some cases, the speed of sound is assumed to be constant, while in other cases, the speed of sound is assumed to vary with temperature. The system 10 may measure an ambient temperature with at least one temperature sensor 24, 25, on at least one of the tag 11 and/or receiver 12. A temperature-dependent speed of sound may then be calculated using the measured temperature, and may be used in the estimated distance calculation.

Other methods of determine distance may also be used. For example, the signals 20 may decay in intensity or amplitude with increasing distance from the tag 11. In some cases, this decay is measurable as a spatial variation in signal strength, such as what one might find as the hand-held receiver 12 is moved relative to the tag 11 in a building. This spatial variation in signal strength may be measured and compared with an expected decay pattern for the respective signal or signals. The spatial variation may be used, in whole or in part, to help calculate a distance to the tag 11 from the receiver 12 for at least one of the emitted signals (e.g. at least one of the acoustic 21, electromagnetic 22 and/or magnetic 23 signals). This may be in addition to, or instead of, using the speed of sound to help determine distance, as described above.

In some cases, the tag 11 may emit the signals 20 in one-way communication to the receiver 12, without receiving any information from the receiver 12, as is shown in FIG. 1. In other cases, the tag 11 may be in two-way communication with the receiver 12.

Figure 2:
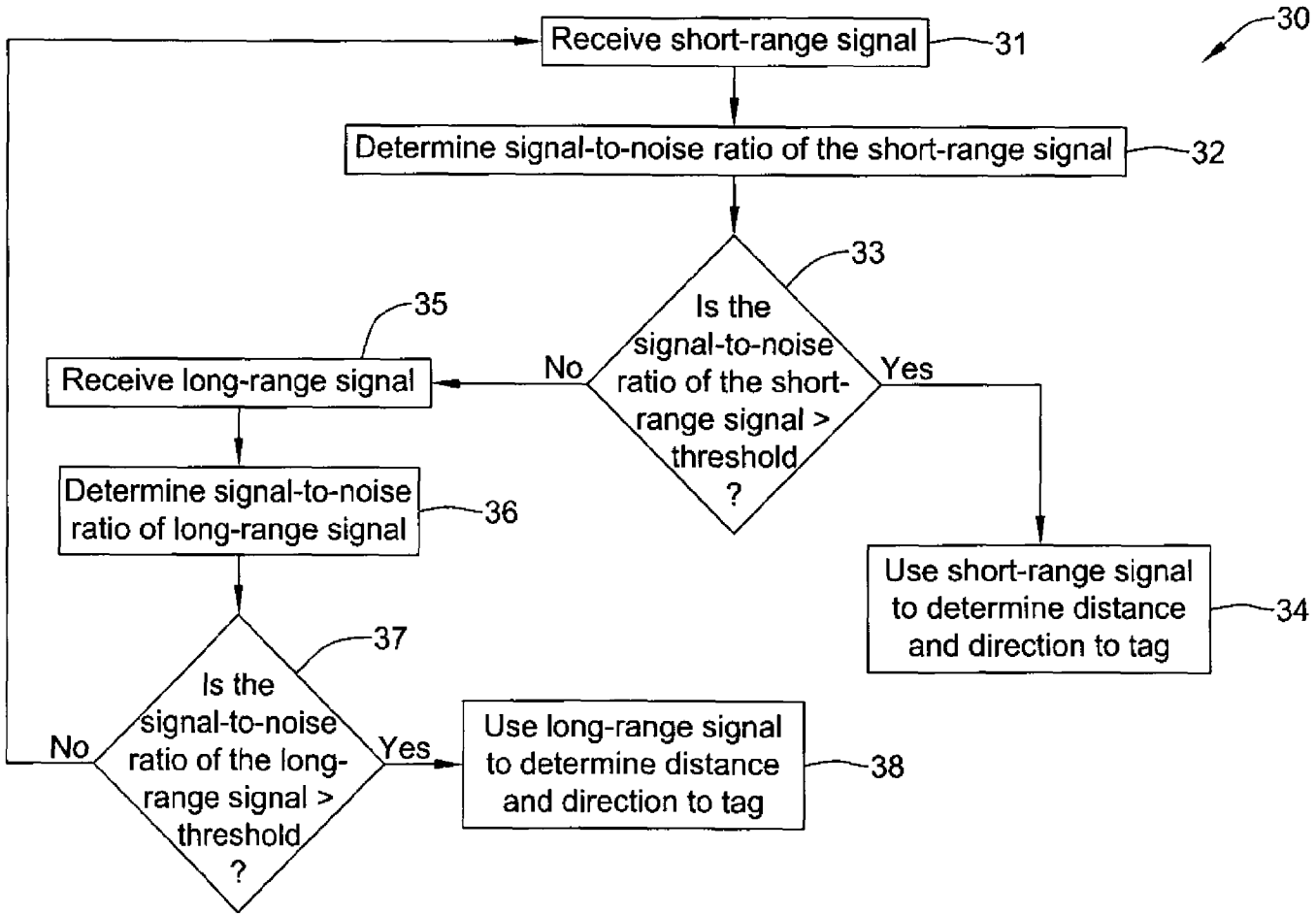
FIG. 2 is a flowchart of an illustrative selection algorithm for receiving first and second signals, and for choosing which of the signals to use when determining a distance and/or a bearing to the tag.

Given that the tag 11 may emit signals 20 based on different physical principles, all of which are capable of being received by the receiver 12 under certain conditions, the receiver 12 may include one or more algorithms to decide which of the signals 20 to use in determining a distance and/or bearing to the tag 11. The receiver 12 may include a processor to execute the one or more algorithms. In some instances, the processor may be a microprocessor, a microcontroller or any other suitable processor, as desired. FIGS. 2-4 are flowcharts showing three example algorithms, while it must be recognized that any suitable algorithm may be used as desired.

FIG. 2 is a flowchart of an illustrative selection algorithm for receiving first and second signals, and for choosing which of the signals to use when determining a distance and/or bearing to the tag 11. In step 31, the receiver 12 attempts to receive a first signal, or in this particular example, a short-range signal. It is assumed throughout this document that the receiver 12 is pre-tuned to a particular frequency or frequencies, if applicable, so that the reception steps typically do not require scanning over a range of frequencies. However, this is not required in all embodiments.

Once a short-range signal is received, the receiver 12 may determine a confidence level, such as a signal-to-noise ratio, of the received short-range signal in step 32. It is assumed throughout this document that any suitable metric may be used in place of signal-to-noise, such as carrier-to-noise or absolute signal strength, as desired. In step 33, the receiver 12 may determine whether the received short-range signal is suitably strong for use by, for example, comparing the signal-to-noise ratio of the short-range signal against a predetermined signal-to-noise threshold. If the short-range signal is suitably strong, then the receiver 12 may use the short-range signal, at least in part, to determine a distance and/or bearing to the tag 11 in step 34.

In step 35, the receiver 12 attempts to receive a second signal, or in this particular example, a long-range signal. Once a long-range signal is received, the receiver 12 may determine a confidence level, such as a signal-to-noise ratio, of the received long-range signal in step 36. In step 37, the receiver 12 may determine whether the received long-range signal is suitably strong for use by, for example, comparing the signal-to-noise ratio of the long-range signal against a predetermined signal-to-noise threshold. If the long-range signal is suitably strong, then the receiver 12 may use the long-range signal, at least in part, to determine a distance and/or bearing to the tag 11 in step 38.

The steps above may be repeated periodically, since it is assumed that the receiver 12 is being moved within a building toward the tag 11. In some cases, as the receiver 12 may be moved toward the tag 11 in distance and/or pivoted toward the tag 11 in direction, the signal-to-noise ratio of the short-range signal may increase from below the threshold to above the threshold. The receiver 12 may automatically being using the short-range signal, at least in part, to determine a distance and/or bearing to the tag 11. Likewise, if the signal-to-noise ratio of the short-range signal falls below the threshold, the receiver 12 may automatically stop using the short-range signal, at least in part, to determine a distance and/or bearing to the tag 11. The same may be true for the long-range signal.

In FIG. 2, the terms "short-range" and "long-range" are relative terms, and are meant to imply only that the "long-range" signal has a longer range than the "short-range" signal given the current environment and/or conditions. In some cases, the short-range signal may be an ultrasonic acoustic signal, and the long-range signal may be an electromagnetic or magnetic signal. However, in some environments, an ultrasonic acoustic signal may be detected at a further distance from the tag 11 than an RF signal. More generally, the terms "short-range" signals and "long-range" signals may simply be referred to as first and second signals, if desired.

FIG. 3 is a flowchart of an illustrative selection algorithm 40 for receiving first-, second- and third signals, and choosing which signals to use for determining a distance and/or a bearing to the tag 11. FIG. 3 is similar to FIG. 2, but includes three signals rather than just two signals. In step 41, the receiver 12 may attempt to receive a first signal from the tag 11. Once a first signal is received, the receiver 12 may determine a signal-to-noise ratio of the received first signal in step 42. In step 43, the receiver 12 may determine whether the received first signal is suitably strong for use, by for example, comparing the signal-to-noise ratio of the first signal against a predetermined signal-to-noise threshold. If the first signal is suitably strong, then the receiver 12 may use the first signal, at least in part, to determine a distance and/or bearing to the tag 11 in step 44. If the first signal is not suitably strong, the receiver 12 may move to step 45.

Step 45 receives a second signal. The receiver 12 may determine a signal-to-noise ratio of the received second signal in step 46. In step 47, the receiver 12 may determine whether the received second signal is suitably strong for use, by for example, comparing the signal-to-noise ratio of the second signal against a predetermined signal-to-noise threshold. The predetermined signal-to-noise threshold used for the second signal may be the same or different from the predetermined signal-to-noise threshold used for the first signal. If the second signal is suitably strong, the receiver 12 may use the second signal, at least in part, to determine a distance and/or bearing to the tag 11 in step 48. If the second signal is not suitably strong, the receiver 12 may move to step 49.

Step 49 receives a third signal. The receiver 12 may determine a signal-to-noise ratio of the received third signal in step 50. In step 51, the receiver 12 may determine whether the received third signal is suitably strong for use, by for example, comparing the signal-to-noise ratio of the third signal against a predetermined signal-to-noise threshold. The predetermined signal-to-noise threshold used for the third signal may be the same or different from the predetermined signal-to-noise threshold used for the first and second signals. If the third signal is suitably strong, the receiver 12 may use the third signal, at least in part, to determine a distance and/or bearing to the tag 11 in step 52. If the third signal is not suitably strong, the receiver 12 may move back to step 41.

As with FIG. 2, the steps shown in FIG. 3 may be repeated, since it is assumed that the receiver 12 is being moved within a building toward the tag 11. In some cases, as the receiver 12 may be moved toward the tag 11 in distance and/or pivoted toward the tag 11 in direction, the signal-to-noise ratio of the first signal may increase from below the threshold to above the threshold, and the receiver 12 may automatically begin using the first signal, at least in part, to determine a distance and/or bearing to the tag 11. Likewise, as the receiver 12 is moved toward the tag 11 in distance and/or pivoted toward the tag 11 in direction, the signal-to-noise ratio of the second signal may increase from below the threshold to above the threshold, and the receiver 12 may automatically begin using the second signal, at least in part, to determine a distance and/or bearing to the tag 11. Notably, and in some instances, if the signal-to-noise ratio of the first signal decreases below the threshold, the receiver 12 may automatically stop using the first signal to determine a distance and/or bearing to the tag 11. In a similar manner, as the receiver 12 is moved toward the tag 11 in distance and/or pivoted toward the tag 11 in direction, the signal-to-noise ratio of the third signal may increase from below the threshold to above the threshold, and the receiver 12 may automatically begin using the third signal, at least in part, to determine a distance and/or bearing to the tag 11. If the signal-to-noise ratio of the first or second signals decrease below the threshold, the receiver 12 may automatically stop using the first signal and/or second signal to determine a distance and/or bearing to the tag 11. In a specific example of the signals used in FIG. 3, the first signal may be an ultrasonic acoustic signal, the second signal may be an electromagnetic signal such as an RF signal, and the third signal may be a modulating magnetic signal, but these are only example signal types. Such an example is treated explicitly in FIG. 4.

Referring to the illustrative method 60 of FIG. 4, and in step 61, the receiver 12 may attempt to receive an acoustic signal from the tag 11. If an acoustic signal is received, the receiver 12 may determine a signal-to-noise ratio of the received acoustic signal in step 62. In step 63, the receiver 12 may determine whether the received acoustic signal is suitably strong for use, be for example, comparing the signal-to-noise ratio of the acoustic signal against a predetermined signal-to-noise threshold. If the acoustic signal is suitably strong, then the receiver 12 may use the acoustic signal, at least in part, to determine a distance and/or bearing to the tag 11 in step 64.

The receiver 12 may also attempts to receive an electromagnetic signal from the tag 11 in step 65. If an electromagnetic signal is received, the receiver 12 may determine a signal-to-noise ratio of the received electromagnetic signal in step 66. In step 67, the receiver 12 may determine whether the received electromagnetic signal is suitably strong for use, by for example, comparing the signal-to-noise ratio of the electromagnetic signal against a predetermined signal-to-noise threshold. If the electromagnetic signal is suitably strong, the receiver 12 may use the electromagnetic signal, at least in part, to determine a distance and/or bearing to the tag 11 in step 68.

The receiver 12 may also attempt to receive a magnetic signal in step 69. If an magnetic signal is received, the receiver 12 may determine a signal-to-noise ratio of the received magnetic signal in step 70 In step 72, the receiver 12 may determine whether the received magnetic signal is suitably strong for use, by for example, comparing the signal-to-noise ratio of the magnetic signal against a predetermined signal-to-noise threshold. If the magnetic signal is suitably strong, the receiver 12 may use the magnetic signal, at least in part, to determine a distance and/or bearing to the tag 11 in step 74.

In the specific examples of FIGS. 2-4, for each determination of distance and/or bearing to the tag 11, information from only one signal at a time may be utilized, or any suitable combination of signals may be used as desired. In some cases, and when two or more signals are received and used to determine a distance and/or bearing to the tag 11 in step 74, the receiver 12 may generate and apply relative weights for each signal. For example, if the hand-held receiver 12 receives an acoustic signal, an RF signal and a magnetic signal, the receiver 12 may determine the respective confidence levels (e.g. signal-to-noise ratios), and may determine relative weights based on their respective signal-to-noise ratios. If a particular signal has a relatively high signal-to-noise ratio, it may be deemed as especially reliable, and may be weighted more heavily than a signal having a relatively low signal-to-noise ratio. In some cases, the receiver 12 may combine the information from the various signals based on their relative weights, and may produce an estimated distance and/or bearing to the tag 11 from the receiver 12 based on the combined information.

As a specific example, if the signal-to-noise ratios of the acoustic and electromagnetic signals are such that the acoustic signal is weighted as 90% and the electromagnetic signal is weighted as 10%, then the distance and/or bearing to the tag 11 may be calculated twice, once each for the acoustic and electromagnetic signals, and the overall distance and/or bearing may be formed as a blend of the two calculations, with the acoustic-derived distance and/or bearing being weighed nine times as heavily as the electromagnetic derived distance and/or bearing. In some cases, for this example, the two calculated distances and bearings may be compared with each other. If the two sets of quantities agree, then a relatively strong user interface signal may be produced. If the two sets of quantities disagree, then the relative weighting and blending of the distance and bearing estimates may be sued, as described above. In some cases, different weightings may be used for distance and for bearing.

In general, the hand-held receiver 12 may communicate a determined distance and bearing to rescue personnel. Because the receiver 12 is expected to operate within a noisy, smoky and/or dangerous environment (e.g. a burning building), it is contemplated that the receiver 12 may communicate through several sensory channels. For instance, there may be a visual component, where the receiver 12 may use, for example, solid or flashing lights to indicate a bearing to walk. In some cases, the frequency of the flashing may indicate a reliability of the signal or an estimated proximity to the tag 11. In some cases, there may be an audible component, with, for example, a tone that moves up or down in pitch depending on whether the person is moving closer to or away from the tag 11. There may be a tactile component, such as a shaking or vibrating, which may modulate depending on where the person is moving closer to or away from the tag 11. In some instances, the receiver 12 may use more than one of these sensory outputs simultaneously, to simplify the difficult job of the person holding the receiver 12.

Having thus described some illustrative embodiments of the present disclosure, those of skill in the art will readily appreciate that yet other embodiments may be made and used within the scope of the claims hereto attached. It will be understood that this disclosure is, in many respect, only illustrative.

What is claimed is:

1. A method for locating a tag in an environment, the tag emitting a first signal and a second signal, the method comprising the repeated steps of:

receiving the first signal at a hand-held receiver;

receiving the second signal at the hand-held receiver;

the first signal and the second signal having disparate propagation characteristics in the environment;

determining a confidence level for the first signal and a confidence level for the second signal; and determining a distance and/or direction of the tag relative to the hand-held receiver based, at least in part, on the received first signal, the received second signal, the confidence level for the first signal, and the confidence level for the second signal.

2. The method of claim 1, wherein the first signal is an acoustic signal, and the second signal is an electromagnetic signal.

3. The method of claim 2, wherein the second signal is an RF signal.

4. The method of claim 1 wherein the first signal is a modulated and time synchronized coded signal.

5. The method of claim 1 wherein the second signal is a modulated and time synchronized coded signal.

6. The method of claim 1, wherein the confidence level of the first signal is related to a signal-to-noise ratio of the first signal, and the confidence level of the second signal is related to a signal-to-noise ratio of the second signal.

7. The method of claim 1, wherein a first weight is applied to the first signal and a second weight is applied to the second signal to arrive at a composite distance and/or direction of the tag relative to the hand-held receiver, wherein the first weight is related to the confidence level for the first signal and the second weight is related to the confidence level for the second signal.

8. A hand-held receiver unit for locating a tag in an environment, comprising:

a receiver for receiving a first signal and a second signal from the tag, wherein the first signal and the second signal having disparate propagation characteristics in the environment;

a processor for determining a confidence level for the first signal and a confidence level for the second signal; and the processor determining a distance and/or direction of the tag relative to the receiver unit based, at least in part, on the received first signal, the received second signal, the confidence level for the first signal, and the confidence level for the second signal.

9. The hand-held receiver unit of claim 8, wherein the confidence level of the first signal is related to a signal-to-noise ratio of the first signal, and the confidence level of the second signal is related to a signal-to-noise ratio of the second signal.

10. The hand-held receiver unit of claim 8, wherein the processor applies a first weight to the first signal and a second weight to the second signal to arrive at a composite distance and/or direction of the tag relative to the receiver unit, wherein the first weight is related to the confidence level for the first signal and the second weight is related to the confidence level for the second signal.

11. The hand-held receiver unit of claim 8, wherein the first signal is an acoustic signal, and the second signal is an electromagnetic signal.

12. The hand-held receiver unit of claim 11, wherein the second signal is an RF signal.

13. The hand-held receiver unit of claim 8, wherein the first signal is an acoustic signal, and the second signal is a magnetic signal.

14. The hand-held receiver unit of claim 8, wherein the first signal is an electromagnetic signal, and the second signal is a magnetic signal.

15. The hand-held receiver unit of claim 8, wherein the receiver is configured to also receive a third signal from the tag, and the processor determines a confidence level for the third signal, and determines the distance and/or direction of the tag relative to the receiver unit based, at least in part, on two or more of:

the received first signal along with the confidence level for the first signal;

the received second signal along with the confidence level for the second signal; and the received third signal along with the confidence level for the third signal.

16. A locator system, comprising:

a tag for emitting both an acoustic signal and a radio frequency (RF) signal;

a hand-held receiver capable of receiving the acoustic signal and the RF signal;

wherein the receiver determines relative weights for the acoustic signal and the RF signal based on their respective signal-to-noise ratios;

wherein the receiver combines information from the acoustic signal and the RF signal based, at least in part, on their relative weights; and wherein the receiver produces an estimated distance and bearing to the tag relative to the receiver based on the combined information.

17. The locator system of claim 16, wherein if the signal-to-noise ratio of the acoustic signal does not exceed a predetermined acoustic signal threshold, then the acoustic signal is not used when determining the estimated distance and bearing to the tag.

18. The locator system of claim 16, wherein if the signal-to-noise ratio of the RF signal does not exceed a predetermined acoustic signal threshold, then the RF signal is not used when determining the estimated distance and bearing to the tag.

19. The locator system of claim 16, wherein the acoustic signal and the RF signal are modulated and time synchronized coded signals.

* * * * *